US010648675B2

(12) United States Patent
Serabatir

(10) Patent No.: US 10,648,675 B2
(45) Date of Patent: May 12, 2020

(54) HOUSEHOLD APPLIANCE COMPRISING A KNOB WITH ILLUMINATED OUTER PERIPHERY

(71) Applicant: ARCELIK ANONIM SIRKETI, Istanbul (TR)

(72) Inventor: Davut Ayhan Serabatir, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 15/751,590

(22) PCT Filed: Aug. 3, 2016

(86) PCT No.: PCT/TR2016/050257
§ 371 (c)(1),
(2) Date: Feb. 9, 2018

(87) PCT Pub. No.: WO2017/026960
PCT Pub. Date: Feb. 16, 2017

(65) Prior Publication Data

US 2018/0245795 A1 Aug. 30, 2018

(30) Foreign Application Priority Data

Aug. 10, 2015 (TR) ..... 2015 09834

(51) Int. Cl.
*F24C 7/08* (2006.01)
*F24C 3/12* (2006.01)
(Continued)

(52) U.S. Cl.
CPC ..... *F24C 7/082* (2013.01); *F21V 33/0044* (2013.01); *F24C 3/124* (2013.01);
(Continued)

(58) Field of Classification Search
CPC ..... F24C 3/124; F24C 7/082; G05G 1/105
See application file for complete search history.

(56) References Cited

U.S. PATENT DOCUMENTS

2005/0236263 A1 10/2005 Mazur
2006/0179970 A1 8/2006 Watanabe
(Continued)

FOREIGN PATENT DOCUMENTS

ES 2200723 A1 3/2004
JP 2005196500 A 7/2005
(Continued)

OTHER PUBLICATIONS

International search report and written opinion, dated Nov. 18, 2016, of International Application No. PCT/TR2016/050257; 10 pgs.

*Primary Examiner* — Andrew J Coughlin
*Assistant Examiner* — Zachary J Snyder
(74) *Attorney, Agent, or Firm* — Kilpatrick Townsedn & Stockton LLP

(57) ABSTRACT

The household appliance of the present invention relates to a control panel by which the user can control the functions of the household appliance; at least one opening disposed on the control panel; a shaft that is disposed behind the control panel so as to extend towards the opening and that enables the related function to be realized; a knob that is disposed on the shaft and that enables the user to move the shaft; a sealing element that is disposed on the opening so as to almost completely surround the shaft.

6 Claims, 4 Drawing Sheets

Figure 1:
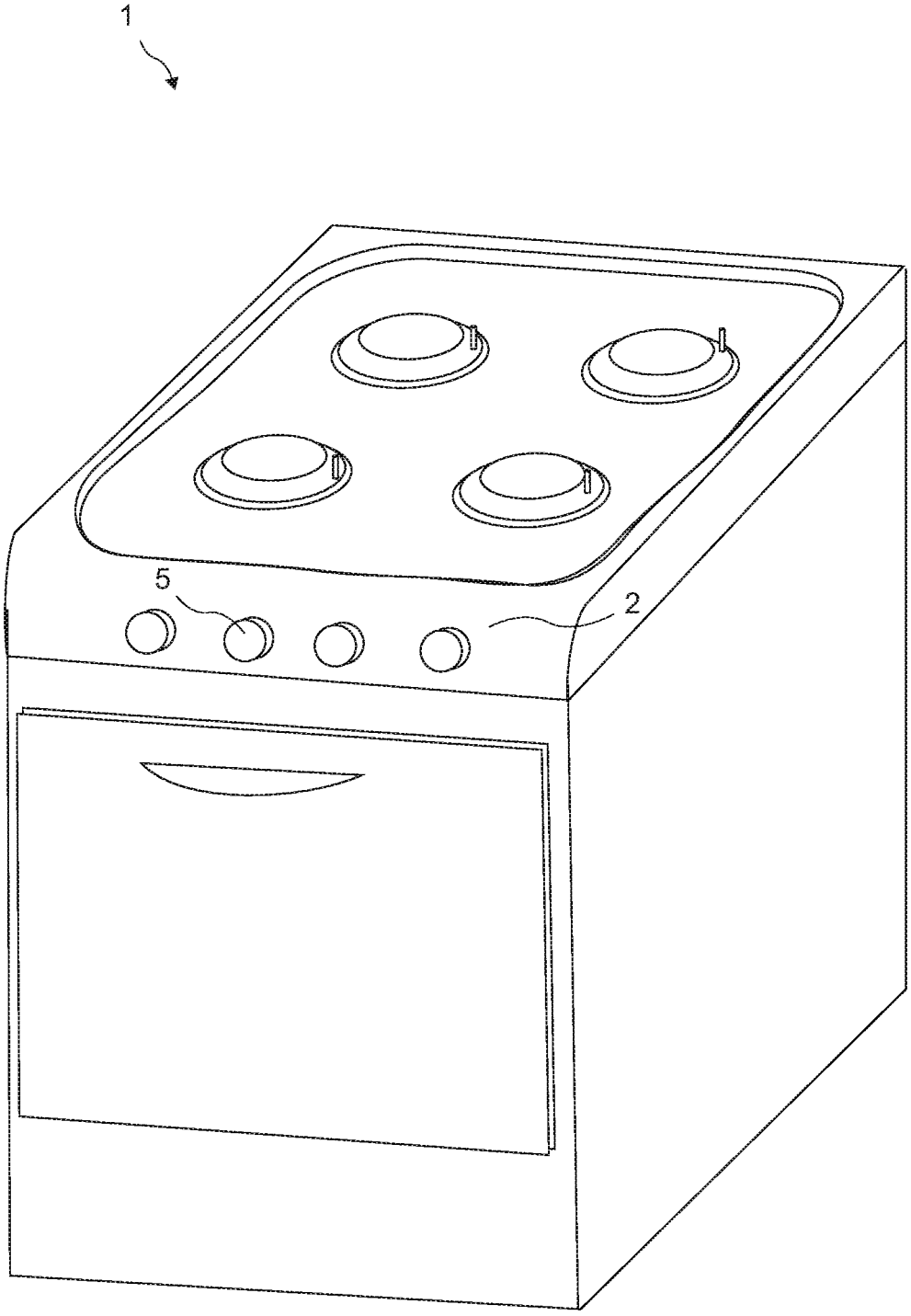

(51) Int. Cl.

| | |
|---|---|
| ***G05G 1/10*** | (2006.01) |
| ***G05G 25/04*** | (2006.01) |
| ***H01H 19/02*** | (2006.01) |
| ***H01H 19/06*** | (2006.01) |
| ***F21V 33/00*** | (2006.01) |
| ***F21Y 115/10*** | (2016.01) |

(52) U.S. Cl.
CPC ..... *G05G 1/105* (2013.01); *G05G 25/04* (2013.01); *H01H 19/025* (2013.01); *H01H 19/065* (2013.01); *F21Y 2115/10* (2016.08); *H01H 2219/0622* (2013.01); *H01H 2223/002* (2013.01); *H01H 2231/012* (2013.01)

(56) References Cited

U.S. PATENT DOCUMENTS

| | | | | |
|---|---|---|---|---|
| 2013/0163226 | A1* | 6/2013 | Chen | B60K 37/06 362/85 |
| 2014/0204557 | A1* | 7/2014 | Cadima | F21V 33/0044 362/23.07 |
| 2017/0027378 | A1* | 2/2017 | Millett | A47J 27/004 |

FOREIGN PATENT DOCUMENTS

| | | | |
|---|---|---|---|
| JP | 2008057830 | A | 3/2008 |
| WO | 2012089506 | A1 | 7/2012 |
| WO | 2014102384 | A1 | 7/2014 |
| WO | 2015043880 | A1 | 4/2015 |

* cited by examiner

HOUSEHOLD APPLIANCE COMPRISING A KNOB WITH ILLUMINATED OUTER PERIPHERY

RELATED APPLICATIONS

This application is a U.S. National Phase of International Application No. PCT/TR2016/050257, filed Aug. 3, 2016, claiming priority to Turkish Patent Application No. 2015/09834, filed Aug. 10, 2015, contents of which are hereby incorporated by reference in their entirety.

The present invention relates to a household appliance that comprises a knob the outer periphery of which is illuminated and that is disposed on the control panel.

On the control panels of household appliances, for example of cooking appliances, knobs are provided that enable the household appliance to be operated. The outer peripheries of the knobs are illuminated in terms of ease of use and decorative appearance. The peripheries of the knobs are illuminated by disposing light sources in the lower portion of the control panel so as to be aligned with the knob. The light beam emitted from the light source is transmitted around the knob by using elements that are called light guide and that enable the light to be transmitted from one point to another point. The periphery of the knob is homogeneously illuminated by using light emitter elements that enable the light to be emitted. In the household appliances wherein the volume under the control panel is narrow, especially in the cooking appliances, the placement of a number of elements like light source, light guide and light emitter used for the transmission of the light around the knob poses a problem.

In the state of the art International Patent Application No. WO2012089506, a household appliance is disclosed, comprising a knob the outer periphery of which is illuminated.

In the state of the art Japanese Patent Application No. JP2008057830, a cooking appliance is disclosed, wherein elements like light source and light guide are disposed on a frame produced from plastic.

In the state of the art Japanese Patent Application No. JP2005196500, a cooking appliance is disclosed, wherein the periphery of the knob is illuminated by the light beam emitted from the light source by means of reflectors.

In the state of the art International Patent Application No. WO2015043880, a cooking appliance is disclosed, wherein the liquid entry around the knobs is prevented by means of a sealing element.

The aim of present invention is the realization of a household appliance comprising a knob the outer periphery of which is homogenously illuminated and that is disposed on the control panel.

The household appliance realized in order to attain the aim of the present invention, explicated in the first claim and the respective claims thereof, comprises a sealing element that prevents liquid entry behind the control panel from around the knobs that are disposed on the control panel, and that is produced from transparent material; and at least one light source that is aligned with the sealing element behind the control panel. The light emitted from the light source enables the illumination around the knob without the need of a separate element by means of the transparent sealing element.

In an embodiment of the present invention, the sealing element is seated on the opening so as to extend both on and behind the control panel in order to provide better leak-proofing and densely illuminate the periphery of the knob with the light emitted from the light source. By means of this embodiment, the light emitted from the light source and transmitted to the sealing element illuminates the periphery of the knob without losing density. By means of this embodiment, the control panel is squeezed within the sealing element along the opening.

In another embodiment of the present invention, the sealing element is produced from silicone. Thus, the sealing element is enabled to be flexible and to homogeneously illuminate the periphery of the knob by emitting the light.

In another embodiment of the present invention, the sealing element is semi-transparent. By means of the semi-transparent sealing element, the periphery of the knob is homogeneously illuminated by homogeneously emitting the light in the sealing element.

In another embodiment of the present invention, the sealing element is transparent. By means of the transparent sealing element, an effective illumination is enabled with less dense light. The transparent sealing element does not absorb the light much, thus enabling the same to be directly transmitted.

In another embodiment of the present invention, the periphery of the knob is constantly illuminated. By means of the constant illumination of the periphery of the knobs, the visual quality of the household appliance is enhanced and the quality perception of the user is improved.

In another embodiment of the present invention, the periphery of the knob is illuminated only while the knob is being moved. By operating the light source only while the knob is being used/rotated, decrease in energy consumption is provided.

In another embodiment of the present invention, the light source emits lights in different colors for different functions of the knob. For example, the light source, that emits blue color light when the knob is rotated in order to turn on the gas tap, can emit red color light when the knob is pushed inside in order to ignite the igniter and burn the gas.

In another embodiment of the present invention, the light source is a light emitting diode that stands out with low energy consumption.

By means of the present invention, the illumination around the knobs on the control panel with the least amount of elements possible in the household appliances is realized.

A household appliance realized in order to attain the aim of the present invention is illustrated in the attached figures, where:

FIG. 1—is the perspective view of a household appliance.

Figure 2:
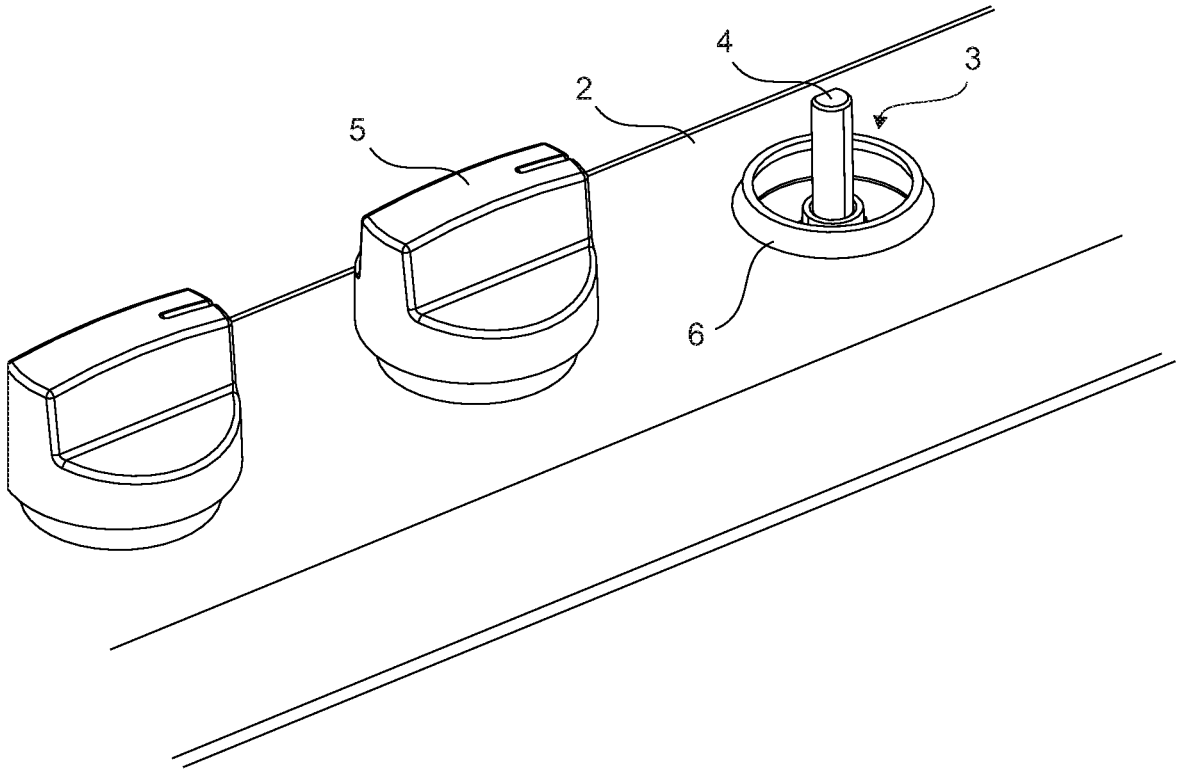

FIG. 2—is the perspective view of the control panel, the knob and the shaft in an embodiment of the present invention.

Figure 3:
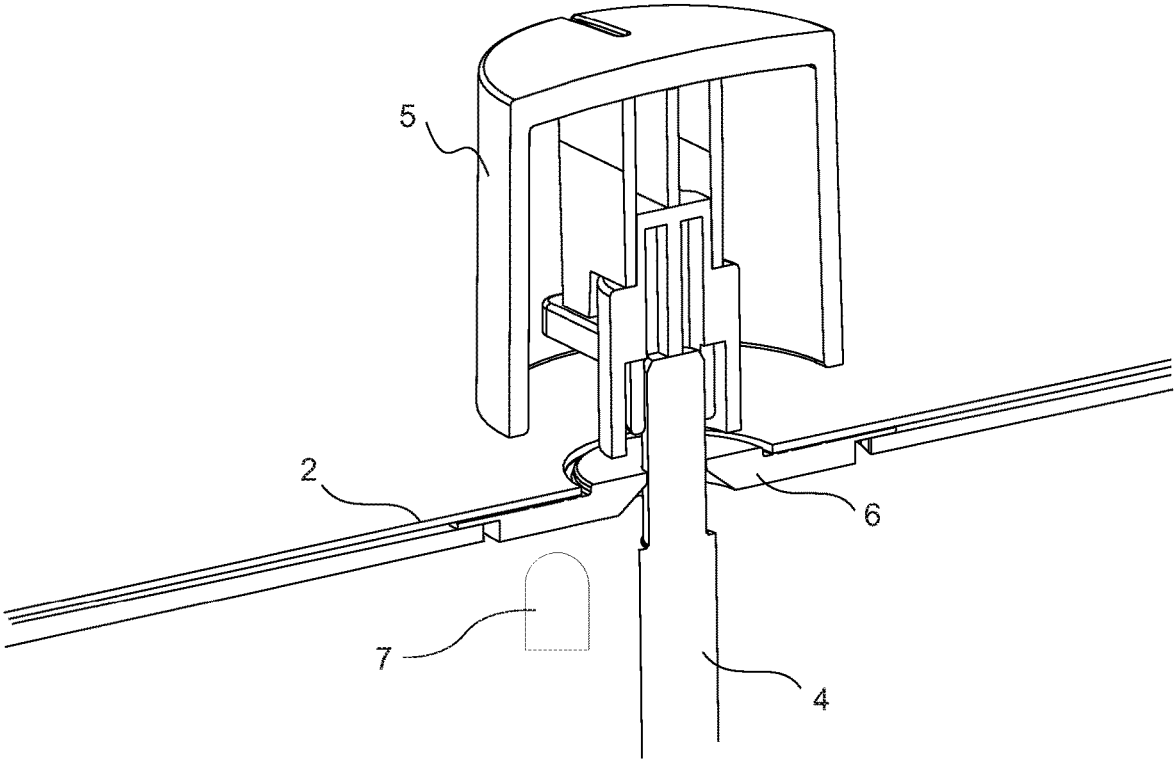

FIG. 3—is the cross-sectional view of the control panel, the knob, the shaft and the sealing element in another embodiment of the present invention.

Figure 4:
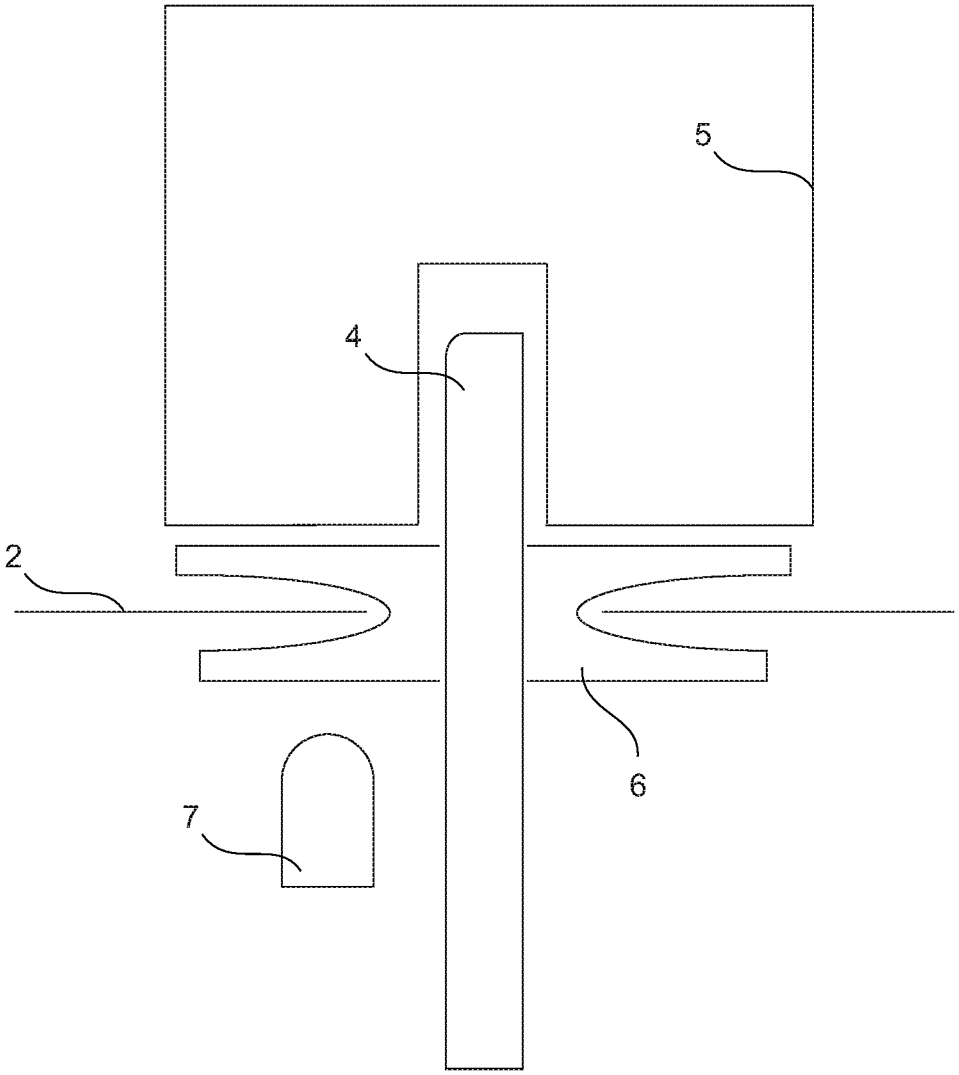

FIG. 4—is the schematic view of the control panel, the knob, the shaft, the sealing element and the light source in another embodiment of the present invention.

The elements illustrated in the figures are numbered as follows:

1. Household appliance
2. Control panel
3. Opening
4. Shaft
5. Knob
6. Sealing element
7. Light source The household appliance (1) comprises a control panel (2) by which the user can control the functions of the household appliance (1); at least one opening (3) disposed on the control panel (2); a shaft (4) that is disposed behind the control panel (2) so as to extend towards the opening (3) and that enables the related function to be realized; a knob (5) that is disposed on the shaft (4) and that enables the user to move the shaft (4); a sealing element (6) that is disposed on the opening (3) so as to almost completely surround the shaft (4) and that almost completely prevents liquid entry behind the control panel (2) from around the knob (5).

The user enables the shaft (4) to move by rotating or pushing the knob (5) inward and realizes the function that the shaft (4) enables to be realized. For example, in the case the household appliance (1) is a cooker, the shaft (4) controls the tap that enables the gas to be sent to the cooker and the user provides gas flow to the cooker by rotating the knob (5). When the household appliance (1) is an oven, the user adjusts the temperature of the oven with the knob (5). The sealing element (6) sits tightly around the opening (3) and prevents the electronic elements like the control card (not shown in the figures) disposed behind the control panel (2) from being damaged due to reasons like cleaning by preventing liquid entry from the opening (3).

The household appliance (1) of the present invention comprises the sealing element (6) produced from transparent material, and at least one light source (7) that is aligned with the sealing element (6) behind the control panel (2) and that enables the illumination of the periphery of the knob (5).

The light source (7) remains behind the control panel (2) is positioned as close as possible to the sealing element (6) in order to effectively illuminate the sealing element (6), in other words in order to transmit the emitted light more effectively to the sealing element (6). The light source (6) is connected to the control unit (not shown in the figures) of the household appliance (1), and is energized according to the information recorded in the memory of the control unit regarding when and how long the illumination is to be made.

By producing the sealing element (6) from transparent material, the need for the use of elements like the light guide, etc. that provide the transmitting and the emitting of the light behind control panel (2) in order to illuminate the periphery of the knob (5) is eliminated. Thus, volume saving in the illumination of the knob (5) is provided and cost advantage is provided by using less elements. The sealing element (6) can be positioned so as to be over or under the control panel (2).

In an embodiment of the present invention, at least a portion of the sealing element (6) is disposed on the opening (3) so as to extend over the control panel (2) and at least a portion thereof extends behind the control panel (2), in other words the sealing element (6) grasps the control panel (2) from both sides. By means of this embodiment of the present invention, the liquid entry prevention function of the sealing element (6) is improved; and by means of the sealing element (6) extending so as to remain on the control panel (2), more effective illumination of the periphery of the knob (5) is enabled. In this embodiment, the light emitted from the light source (7) that is disposed behind the control panel (2) is coupled with the sealing element (6); and the sealing element (6) enables the light to be carried on the control panel (2) so as to illuminate the periphery of the knob (5) by acting as a light guide.

In another embodiment of the present invention, the sealing element (6) is produced from silicone material. By means of the sealing element (6) produced from silicone material, the sealing element (6) gains the feature of flexibility, for example the user is enabled to easily take out and clean the sealing element (6) when dirty.

In another embodiment of the present invention, the sealing element (6) is semi-transparent. By means of the semi-transparent sealing element (6), the light received from the light source (7) is enabled to be emitted in a better way in the sealing element (6) and thus the periphery of the knob (5) is more homogenously illuminated.

In another embodiment of the present invention, the sealing element (6) is transparent. By using a transparent sealing element (6), while the periphery of the knob (5) is illuminated, a different experience is provided to the user by enabling the user to see behind the control panel (2).

In another embodiment of the present invention, the lights source (7) constantly emits light. By means of constant illumination of the periphery of the knob (5), the user can easily see the writings and the figures around the knob (5) while using the knob (5) even if the environment is not alight.

In another embodiment of the present invention, the lights source (7) emits light while the knob (5) is being moved. By means of this embodiment, in addition to the above-explained embodiment, the lights source (7) emits light only while the knob (5) is being used and thus energy saving is provided.

In another embodiment of the present invention, the light source (7) emits light in different colors for different functions of the household appliance (1). In this embodiment, more than one light source (7) can be used for light in different colors or the light sources (7) that emit light in different colors at different voltages can be used. Thus, the user can easily detect which function is realized with the knob (5).

In another embodiment of the present invention, the light source (7) is a light emitting diode. By using a light emitting diode as the light source (7), less energy is consumed for the illumination of the periphery of the knob (5) in comparison with other state of the art light sources (7).

In the present invention, the sealing element (6) used for leak-proofing purposes in the periphery of the knob (5) gains a second function by being produced from transparent material, and enables the light of the light source (7) disposed behind the control panel (2) to pass therethrough and enables the light to be emitted so as to illuminate the periphery of the knob (5). By means of the sealing element (6) having two functions, the narrow volume behind the control panel (2) is used more efficiently.

The invention claimed is:

1. A household appliance comprising:

a control panel by which a user can control functions of the household appliance;

at least one opening disposed on the control panel;

a shaft that is disposed behind the control panel so as to extend towards the opening and that enables a related function to be realized;

a knob that is disposed on the shaft and that enables the user to move the shaft;

a sealing element that is disposed on the opening so as to almost completely surround the shaft; wherein the sealing element is produced from transparent material, wherein a first transparent portion of the sealing element extends over the control panel and a second transparent portion of the sealing element extends under the control panel such that the first transparent portion and the second transparent portion of the sealing element sandwich the control panel; and a light source that is disposed behind the control panel so as to be aligned with the sealing element, wherein the first transparent portion and the second transparent portion of the sealing element are configured to emit light emitted from the light source and illuminate the knob by illuminating over and under the control panel.

2. The household appliance as in claim 1, characterized by the sealing element produced from silicone material.

3. The household appliance as in claim 1, characterized by the light source that constantly emits light.

4. The household appliance as in claim 1, characterized by the light source that emits light while the knob is being moved.

5. The household appliance as in claim 1, characterized by the light source that emits light in different colors for different functions.

6. The household appliance as in claim 1, characterized by the light source that is a light emitting diode.

* * * * *